US006186421B1

(12) United States Patent
Wahba et al.

(10) Patent No.: US 6,186,421 B1
(45) Date of Patent: Feb. 13, 2001

(54) FUEL INJECTOR

(75) Inventors: Brent Jack Wahba, Honeoye Falls, NY (US); Harrie William Bonnah, II, East Grand Rapids, MI (US); Michael Schneider, Rochester, NY (US); George A. Kotkowicz, Grand Rapids, MI (US)

(73) Assignee: Delphi Technologies, Inc., Troy, MI (US)

( * ) Notice: Under 35 U.S.C. 154(b), the term of this patent shall be extended for 0 days.

(21) Appl. No.: 09/455,054

(22) Filed: Dec. 6, 1999

(51) Int. Cl.[7] ..... F02M 51/00
(52) U.S. Cl. ..... 239/585.1
(58) Field of Search ..... 233/585.1, 585.2, 233/585.3, 585.4, 585.5; 251/129.15

(56) References Cited

U.S. PATENT DOCUMENTS

| | | | | |
|---|---|---|---|---|
| 5,769,328 | | 6/1998 | Zdyb et al. . | |
| 5,927,613 | * | 7/1999 | Koyanagi et al. | 239/585.1 |
| 5,967,424 | * | 10/1999 | Bonnah, II | 239/585.1 |
| 5,996,911 | * | 12/1999 | Gesk et al. | 239/585.1 |
| 6,105,884 | * | 8/2000 | Molnar et al. | 239/585.1 |
| 6,123,275 | * | 9/2000 | Geiger et al. | 239/585.3 |

* cited by examiner

*Primary Examiner*—Lesley D. Morris
*Assistant Examiner*—Christopher S. Kim
(74) *Attorney, Agent, or Firm*—John A. VanOphem

(57) ABSTRACT

A fuel injector includes a tubular injector body which has an open, upper end and defines an axial fuel passage. A solenoid actuator assembly is disposed in the injector body and includes a spool-like bobbin with a central through-bore and a wound wire coil supported thereon. A magnetic circuit pole subassembly includes a fuel tube, a valve guide, and a pole piece. The fuel tube has a tubular portion and a lower circular flange portion radially extending from a lower terminal end of the tubular portion to contact the open, upper end of the injector body. The nonmagnetic valve guide has a guide cylindrical portion, extending axially downward through the central throughbore and is closely encircled by the bobbin, and a guide circular flange portion radially extending from an upper end of the guide cylindrical portion and mating with the lower circular flange portion of the fuel tube. The pole piece is configured as a constant section cylinder to be received by the fuel tube tubular portion and the guide cylindrical portion. A valve armature is disposed within the injector body downstream of the pole piece where upon energization of the solenoid actuator assembly, the injector body, fuel tube, pole piece, and armature conduct a magnetic circuit to axially draw the valve armature permitting fuel injection.

4 Claims, 3 Drawing Sheets

FUEL INJECTOR

TECHNICAL FIELD

This invention relates to fuel injectors used for delivery of fuel to internal combustion engines.

BACKGROUND OF THE INVENTION

A solenoid actuated valve assembly operates to inject fuel into an internal combustion engine. To actuate the valve, a magnetic circuit must be established to attract the valve armature to lift the valve off the valve seat. There must be a closed loop of adjacent magnetic components encircling the coil, except for the small working air gap across which the valve assembly armature travels. To satisfy this requirement for a closed loop about the coil, the components may have to be configured in complex geometries which increase manufacturing costs.

For efficient and accurate operation of fuel injection, it is desired to center the valve assembly concentrically within the injector body to ensure axial motion of the valve with respect to the body and the valve seat. In order to achieve this goal, it is preferable for a valve guide to be in direct contact with both the valve and the inner surface of the injector body to ensure concentricity therebetween.

It is also important that the solenoid coil be free of fuel contamination to assure reliable performance. Over time, fuel may degrade the coil windings resulting in reduced injector performance. A known option is to employ hermetic welds between the components encircling the coil to prevent fuel seepage into the coil. The disadvantage of hermetic welds is the increase in assembly costs.

SUMMARY OF THE INVENTION

The present invention is directed to a fuel injector, for use in an internal combustion engine, which includes a novel magnetic circuit pole subassembly. The pole subassembly includes a fuel tube with a lower radial flange, a cylindrical valve guide with a complementary radial flange mating with and hermetically welded to the fuel tube flange to form a fuel-tight cylindrical wall, and a cylindrical pole piece closely encircled by the fuel-tight cylindrical wall.

The cylindrical valve guide and the fuel tube form the fuel-tight cylindrical wall to provide a barrier to fuel seepage into a solenoid actuator assembly. Only one hermetic weld is required between the fuel tube and valve guide mating flanges to achieve fuel containment and seal the solenoid assembly from the risk of fuel contamination. Minimizing the number of hermetic welds required reduces assembly costs for the fuel injector.

The fuel tube radial flange extends to meet the injector body thereby directly integrating the fuel tube into the loop of adjacent magnetic components encircling the solenoid coil which conduct the magnetic circuit upon energization of the solenoid. By integrating the fuel tube into the circuit, the pole piece is simplified to a constant diameter tubular configuration.

The valve guide radial flange extends to directly contact the inner surface of the injector body which provides a centered valve guide relative to the body. This ensures that the injector valve, guided through direct contact with the valve guide, is concentric with the body and translates parallel to the body axis thereby improving injector performance.

DESCRIPTION OF THE PREFERRED EMBODIMENT

Figure 1:
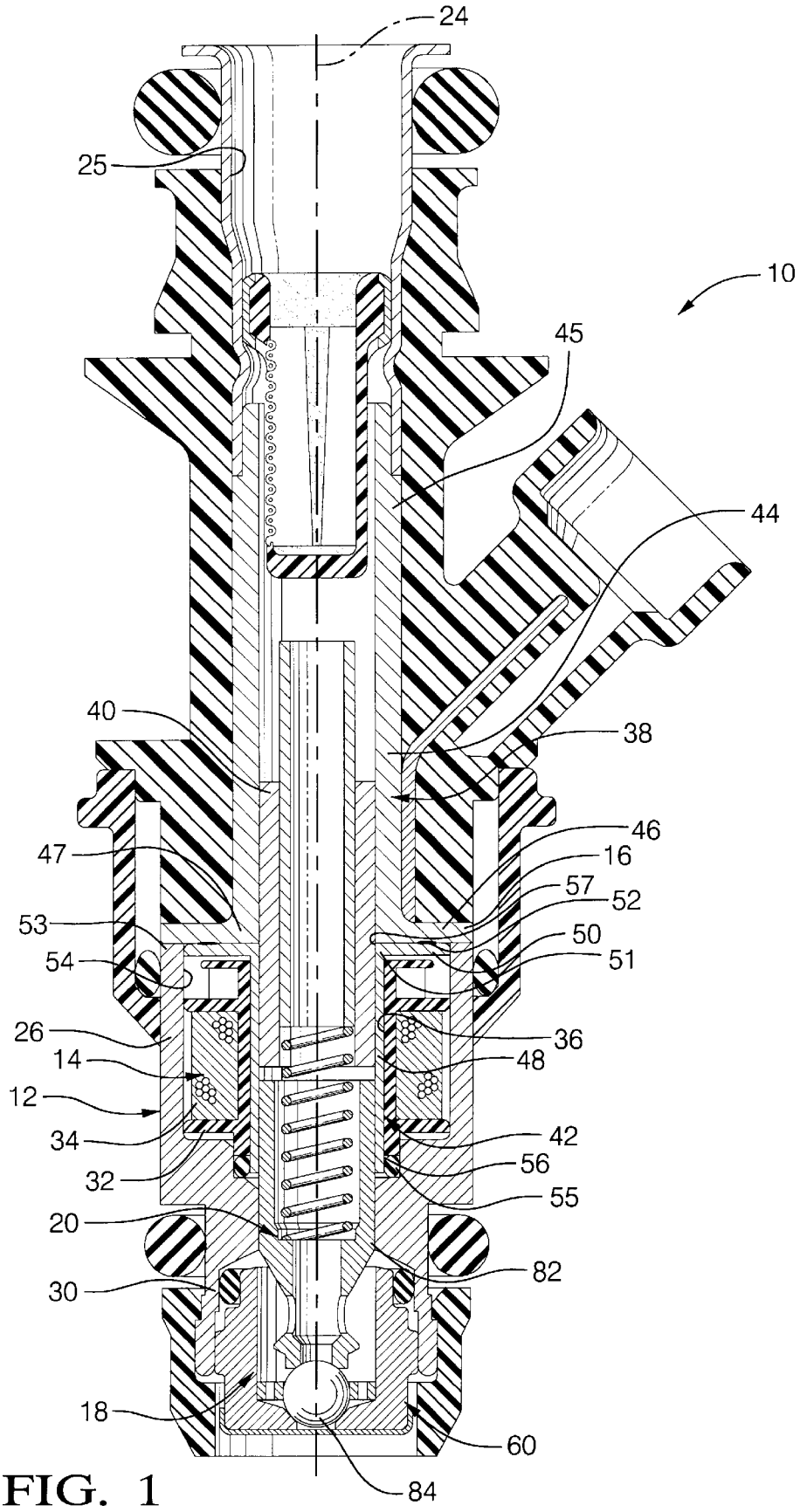
FIG. 1 is a sectional side view of a fuel injector including features of the present invention.
Figure 2:
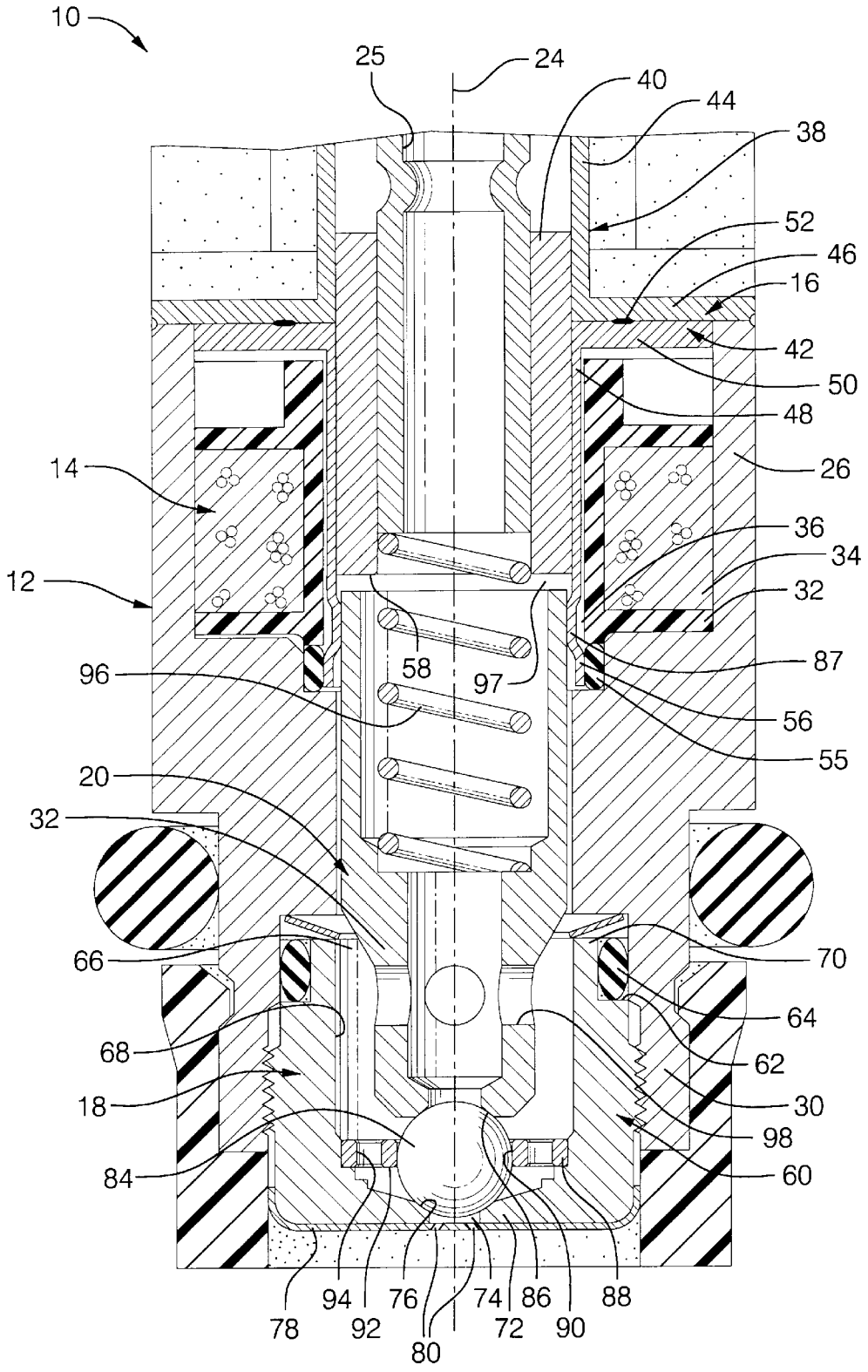
FIG. 2 is a partial side view, in section, of the fuel injector of FIG. 1.

FIGS. 1 and 2 illustrate an electromagnetic fuel injector, designated generally as 10, which includes an injector body 12, a solenoid actuator assembly 14, a magnetic circuit pole subassembly 16, a nozzle assembly 18, and a valve assembly 20.

The injector body 12 is a generally cylindrical, hollow tubular member defining a central axis 24 and a fuel passage 25 therethrough. The body 12 includes an upper solenoid case portion 26 and a lower nozzle case portion 30.

The solenoid actuator assembly 14 is disposed within the upper solenoid case portion 26 and includes a spool-like, tubular bobbin 32 supporting a wound wire solenoid coil 34. The bobbin 32 is provided with a central through-bore 36.

Figure 3:
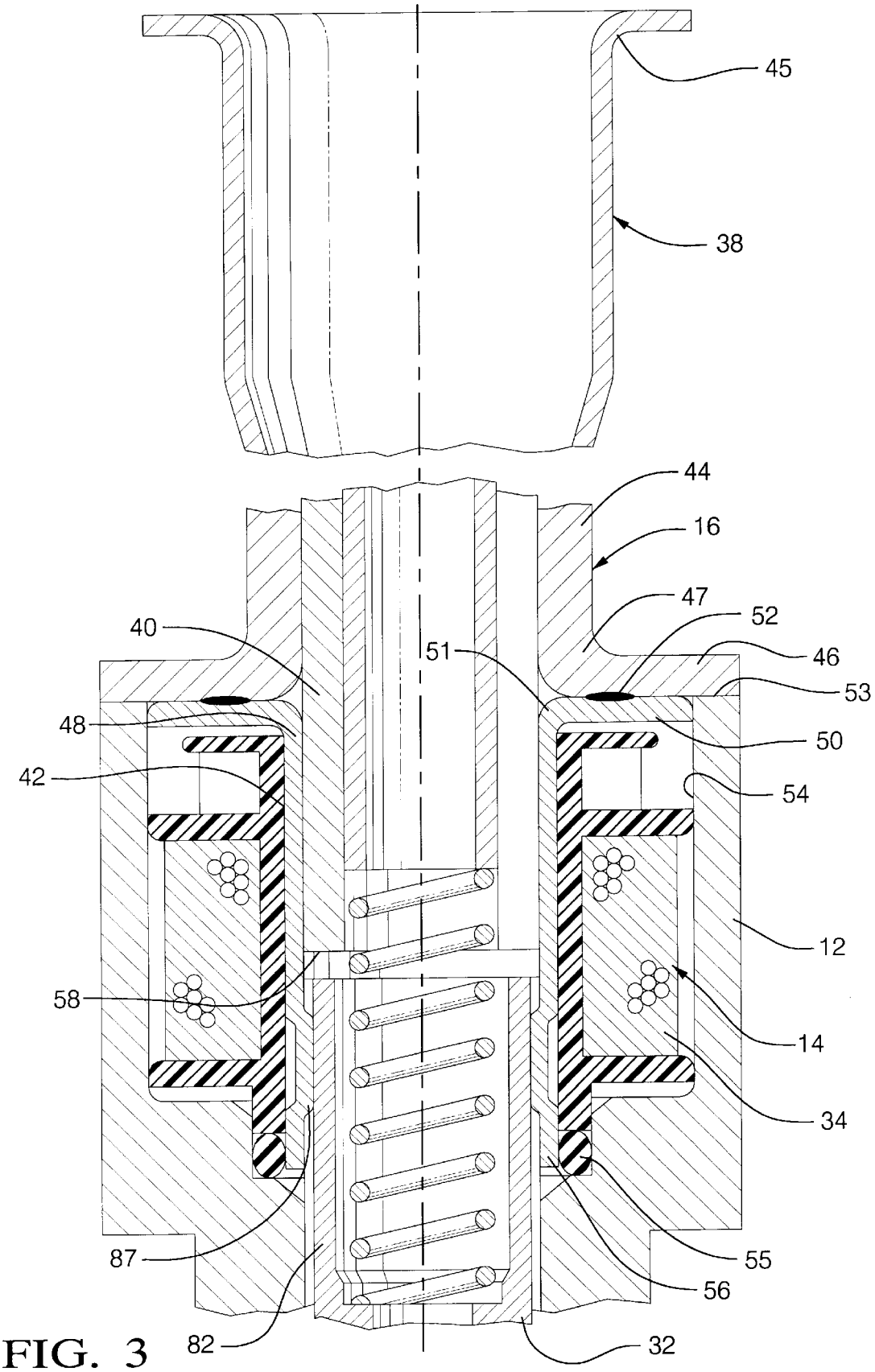
FIG. 3 is an enlarged side view of a portion of FIG. 1.

The magnetic circuit pole subassembly 16, shown most clearly in FIG. 3, includes a fuel tube 38, a pole piece 40, and a valve guide 42. The fuel tube 38 has a tubular portion 44 at a fuel inlet end 45 and a lower circular flange portion 46 radially extending from a lower terminal end 47. The pole piece 40 is a constant section cylinder with an outside diameter which provides for a press fit to the inner diameter of the fuel tube tubular portion 44. The valve guide 42 has a guide cylindrical portion 48 and a guide circular flange portion 50 which radially extends from an upper end 51 of the valve guide. The guide cylindrical portion 48 has an inner diameter sized to encircle the outside diameter of the pole piece 40. The fuel tube and the valve guide circular flanges 46,50 mate and are joined by a hermetically welded seal 52. The fuel tube 38 and the pole piece 40 are both magnetic materials while the valve guide 42 is nonmagnetic material.

The magnetic circuit pole subassembly 16 is partially installed into the injector body 12 such that the pole piece 40 and the valve guide cylindrical portion 48 extend into the central through-bore 36 of the bobbin 32 and the spool-like bobbin 32 closely encircles the guide cylindrical portion 48. The fuel tube circular flange 46 has suitable radius to seat upon an open, upper end 53 of the solenoid case 26 of the injector body 12. The valve guide circular flange 50 contacts the inner surface 54 of the solenoid case 26. The valve guide cylindrical portion 48 extends axially downward below the solenoid bobbin 32. At its terminal end, the outer surface 56 of the guide cylindrical portion 48 interfaces with a resilient sealing member 55 which seals against the injector body 12.

As a result of the installation of the magnetic circuit pole subassembly 16, the pole subassembly and the injector body 12 enclose the solenoid actuator assembly 14 to prevent fuel seepage into the solenoid coil 34. A generally cylindrical fuel barrier or fuel-tight cylindrical wall 57 is formed by the joining of the fuel tubular portion 44 and the guide cylindrical portion 48 through the single hermetically welded seal 52 to prevent fuel seepage through the upper end of the solenoid coil 34, while the resilient sealing member 56 prevents seepage through the lower end of the coil.

The pole piece 40 is of suitable axial length to extend a working surface 58 to an optimum location intermediate the ends of the bobbin central through-bore 36. Location of the working surface 58 of the pole 40 centrally of the coil axial length maximizes magnetic efficiency of the magnetic circuit.

Referring to FIG. 2, the nozzle assembly 18 is disposed within the lower nozzle case portion 30. It includes a nozzle body 60 having a cupshaped configuration with a stepped upper shoulder 62 for receiving a sealing member such as an o-ring 64. The o-ring 64 is disposed between the stepped upper shoulder 62 of the nozzle body 60 and the lower nozzle case portion 30 of the injector body 12, thereby establishing a seal against fuel leakage at the interface of the nozzle assembly 18 and the injector body 12. An internal cylindrical cavity 66 in the nozzle body 60 is defined by a cylindrical wall 68 which extends from an open, upper end 70 of the nozzle body 60 to terminate in a closed, lower end 72 of the nozzle body. The cylindrical cavity 66 operates as a fuel supply repository within the nozzle assembly 18. The closed, lower end 72 of the nozzle body 60 has a fuel discharge opening 74 therethrough, coaxial with the central axis 24 of the injector body 12, and having an annular, frustoconical valve seat 76 disposed thereabout.

At the lower end 72 of the nozzle body 60, downstream of the fuel discharge opening 74, a fuel spray director plate 78 is placed. The director plate 78 includes fuel directing openings 80 extending therethrough. Fuel passing through the fuel discharge opening 74 is distributed across the director plate 78 to the fuel directing openings 80. The fuel directing openings 80 are oriented to generate a desired spray configuration in the fuel discharged from injector 10.

The valve assembly 20 includes a tubular armature 82 extending axially within the injector body 12 and a valve element 84 located within the nozzle body 60. The valve element 84 may be a spherical ball, which is welded to the lower annular end 86 of the tubular armature 82. The radius of the valve element 84 is chosen for seating engagement with the valve seat 76.

The tubular armature 82 is guided by the valve guide 42. In particular, the valve guide cylindrical portion 48 has an annular region 87 of reduced inner diameter to act as an armature bearing surface which contacts and guides the outer surface of the armature 82 as it reciprocates within the injector 10.

As a result of the valve guide 42 being concentrically centered to the injector body 12 through the direct contact of the valve guide circular flange 50 to the inner surface 54 of the injector body, the tubular armature 82 is accurately centered within the injector body 12. This concentric alignment improves valve durability and performance by ensuring axial travel of the armature 82 relative to the body 12 and to the valve seat 76.

Coaxially positioned within the cylindrical cavity 66 of the nozzle body 60, adjacent the valve seat 76 is an annular disk shaped lower valve guide 88 with a central, valve-guiding opening 90. The annular closed bottom 92 has a plurality of fuel passages 94 extending therethrough to allow fuel flow from the cylindrical cavity 66 to the valve seat 76.

The valve element 84 of the valve assembly 20 is normally biased into closed, seated engagement with the valve seat 76 by a biasing member such as a valve return spring 96. Upon energizing the solenoid assembly 14, a magnetic circuit is conducted through the injector body 12, the fuel tube 38, the pole piece 40, and the armature 82. The tubular armature 82 and associated valve element 84 are drawn axially, off the valve seat 76 against the bias of the return spring 96 and across a working air gap 97. Location of the working surface 58 intermediate the ends of the coil 34, as previously described, maximizes directed flux across the working air gap 97 which enhances the efficiency of the solenoid actuator and, consequently, the injector performance. Pressurized fuel enters the injector 10 from a fuel source, not shown, and passes through the fuel passage 25, to enter the cylindrical cavity 66 in the nozzle body 60 through circumferentially spaced openings 98 in the tubular armature 82. The fuel passes through the fuel passages 94 in the lower valve guide 88 and exits through the fuel discharge opening 74 in the valve seat 76. Fuel exiting the fuel discharge opening 74 is distributed across the fuel director plate 78 to the fuel directing openings 80, for discharge from the fuel injector 10. Deenergizing the solenoid assembly 14 releases the tubular armature 82, which returns the valve element 84 to the normally closed position against the valve seat 76 under the bias of the return spring 96, and stops the flow of fuel therethrough.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A fuel injector, comprising:

a tubular injector body having an open, upper end and defining an axial fuel passage;

a solenoid actuator assembly disposed in said injector body and including a spool-like bobbin with a central through-bore and a wound wire coil supported thereon;

a fuel tube having a tubular portion and a lower circular flange portion radially extending from a lower terminal end of said tubular portion to contact said open, upper end of said injector body;

a nonmagnetic valve guide having a guide cylindrical portion, extending axially downward through said central through-bore and closely encircled by said bobbin, and a guide circular flange portion radially extending from an upper end of said guide cylindrical portion and mating with said lower circular flange portion of said fuel tube;

a cylindrical pole piece to be received by said fuel tube tubular portion and said guide cylindrical portion; and a valve armature disposed within said injector body downstream of said pole piece and guided through direct contact with said valve guide;

wherein said injector body, said fuel tube, said pole piece, and said armature conduct a magnetic circuit upon energization of said solenoid actuator assembly to axially draw said valve armature to permit fuel injection.

2. A fuel injector, as defined in claim 1, further comprising:

a hermetically welded seal between said mating lower circular flange portion of said fuel tube and said guide circular flange portion of said valve guide to prevent fuel seepage into said coil; and a resilient sealing member interfaced with said guide cylindrical portion and said injector body to prevent fuel seepage into said coil.

3. A fuel injector, as defined in claim 2, wherein said injector body defines a central axis and further comprises a fuel discharge opening coaxial with said central axis having a valve seat extending thereabout;

a valve element affixed to a lower end of said armature and normally seated on said valve seat to close said fuel discharge opening and operable to move off said valve seat to open said fuel discharge opening allowing fuel to pass therethrough;

said guide circular flange portion contacting an inner surface of said injector body; and said valve guide operable to align said tubular armature with said central axis through direct contact with both said armature and said injector body.

4. A fuel injector, comprising:

a tubular injector body having an open, upper end and defining an axial fuel passage and a central axis;

a fuel discharge opening coaxial with said central axis having a valve seat extending thereabout;

a valve assembly having a tubular armature centered within said injector body and a valve element affixed to a lower end of said armature and normally seated on said valve seat to close said fuel discharge opening and operable to move off said valve seat to open said fuel discharge opening allowing fuel to pass therethrough;

a solenoid actuator assembly disposed in said injector body and including a spool-like bobbin with a central through-bore and a wound wire coil supported thereon;

a magnetic circuit pole subassembly including a fuel tube coaxial with said injector body having a tubular portion and a lower circular flange portion radially extending from a lower terminal end of said tubular portion to contact said open, upper end of said injector body, a nonmagnetic valve guide having a guide cylindrical portion extending coaxially through said central through-bore to below said bobbin and closely encircled by said bobbin, and a guide circular flange portion radially extending from an upper end of said guide cylindrical portion, contacting an inner surface of said injector body and mating with said lower circular flange portion, said valve guide operable to align said armature with said central axis through direct contact with both said armature and said injector body;

a hermetically welded seal between said mating lower circular flange portion and said guide circular flange portion to prevent fuel seepage into said coil;

a pole piece configured as constant section cylinder to be received by said fuel tube tubular portion and said guide cylindrical portion and having a working surface intermediate of said coil to maximize magnetic circuit efficiency; and a resilient sealing member interfaced with said guide cylindrical portion and said injector body to prevent fuel seepage into said coil;

wherein said injector body, said fuel tube, said pole piece, and said tubular armature conduct a magnetic circuit upon energization of said solenoid actuator assembly to attract said armature to said working surface to permit fuel injection through said fuel discharge opening.

* * * * *